US008086394B2

(12) United States Patent
Kim et al.

(10) Patent No.: US 8,086,394 B2
(45) Date of Patent: Dec. 27, 2011

(54) PROVIDING TRAFFIC INFORMATION INCLUDING COMPOSITE LINKS

(75) Inventors: Young In Kim, Seoul (KR); Mun Ho Jung, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 1441 days.

(21) Appl. No.: 11/421,010

(22) Filed: May 30, 2006

(65) Prior Publication Data

US 2006/0274666 A1 Dec. 7, 2006

Related U.S. Application Data

(60) Provisional application No. 60/685,889, filed on Jun. 1, 2005.

(30) Foreign Application Priority Data

Oct. 25, 2005 (KR) ..... 10-2005-0100822

(51) Int. Cl.
*G08G 1/00* (2006.01)

(52) U.S. Cl. ..... 701/117; 701/200; 340/995.13

(58) Field of Classification Search ..... 701/117, 701/200, 208, 210; 340/905, 995.13; 370/349
See application file for complete search history.

(56) References Cited

U.S. PATENT DOCUMENTS 6,434,477 B1 * 8/2002 Goss et al. ..... 701/117
6,470,265 B1 * 10/2002 Tanaka ..... 701/208
6,477,459 B1 * 11/2002 Wunderlich ..... 701/209
6,741,932 B1 * 5/2004 Groth et al. ..... 701/210
6,759,970 B1 * 7/2004 Horita et al. ..... 340/905
6,924,751 B2 * 8/2005 Hempel et al. ..... 340/995.12
7,050,903 B1 * 5/2006 Shutter et al. ..... 701/117
7,251,558 B1 * 7/2007 McGrath ..... 701/117
7,269,503 B2 * 9/2007 McGrath ..... 701/117
7,307,513 B2 * 12/2007 Shutter et al. ..... 340/995.13

(Continued)

FOREIGN PATENT DOCUMENTS

EP 1 041 755 10/2000

(Continued)

OTHER PUBLICATIONS

European Office Action and Search Report issued in Application No. 09158877.2—2215/2077540 dated Jun. 10, 2009.

(Continued)

*Primary Examiner* — Mark Hellner
*Assistant Examiner* — Helal A Algahaim
(74) *Attorney, Agent, or Firm* — Fish & Richardson P.C.

(57) ABSTRACT

A method for processing traffic information includes receiving traffic information including a composite identifier enabling a determination of whether the received traffic information includes composite link information, a composite traffic status indicator revealing traffic status information corresponding to a composite link that includes at least first and second links, and at least first and second link identifiers respectively corresponding to the first and second links that are included within the composite link. The method also includes determining, based on the composite identifier, whether the received traffic information includes composite link information. The method further includes dependent upon whether the composite identifier enables a determination that the received traffic information includes composite link information, identifying the composite link among the received traffic data based on at least the first and second link identifiers, identifying the received composite traffic status indicator as composite traffic status information for the composite link, and enabling perception of an association between the received traffic status information and the composite link.

16 Claims, 9 Drawing Sheets

U.S. PATENT DOCUMENTS

| | | | | |
|---|---|---|---|---|
| 7,355,528 | B2 * | 4/2008 | Yamane et al. | 340/995.13 |
| 7,706,964 | B2 * | 4/2010 | Horvitz et al. | 701/117 |
| 7,729,335 | B2 * | 6/2010 | Lee et al. | 370/349 |
| 2001/1002831 | | 10/2001 | Hessing | |
| 2004/0119612 | A1 * | 6/2004 | Chen | 340/995.13 |
| 2005/0043880 | A1 * | 2/2005 | Yamane et al. | 701/200 |
| 2005/0093720 | A1 * | 5/2005 | Yamane et al. | 340/995.13 |
| 2006/0111833 | A1 * | 5/2006 | Feldman et al. | 701/117 |
| 2006/0267794 | A1 * | 11/2006 | Lee et al. | 340/905 |
| 2008/0140308 | A1 * | 6/2008 | Yamane et al. | 701/200 |

FOREIGN PATENT DOCUMENTS

| | | |
|---|---|---|
| EP | 1 079 353 | 2/2001 |
| EP | 1 445 750 | 8/2004 |
| JP | 11-160081 | 6/1999 |
| KR | 10-2004-0056935 | 7/2004 |
| KR | 10-2006-0063563 | 6/2006 |
| KR | 10-2006-0063629 | 6/2006 |
| KR | 10-2006-0076574 | 7/2006 |

OTHER PUBLICATIONS

European Office Action and Search Report issued in Application No. 09159702.1—2215/2081166 dated Jun. 24, 2009.

International Search Report dated Oct. 19, 2006, for Application No. PCT/KR/2006/002069, 1 page.

European Search Report dated Jun. 13, 2008, for Application No. 06747475.9, 6 pages.

* cited by examiner

```
<link_info_component(01)>:=: Link information component
  <intunti>(id),                  : identifier, id = 01 hex
  <intunli>(n),                   : data length in byte (n)
  m*<link_info_sub_component()>;: link information sub component
```

PROVIDING TRAFFIC INFORMATION INCLUDING COMPOSITE LINKS

CROSS-REFERENCE TO RELATED APPLICATIONS

The present application claims priority from U.S. provisional application No. 60/685,889 filed Jun. 1, 2005, which is titled "Traffic information signal and method and apparatus for providing link information through the signal," the entire contents of which are incorporated herein by reference. The present application also claims priority to Korean application No. 10-2005-0100822 filed Oct. 25, 2005, the entire contents of which are incorporated herein by reference.

BACKGROUND

1. Field

The present document relates to providing traffic information including composite link and using the provided traffic information.

2. Description of the Related Art

With the advancement in digital signal processing and communication technologies, radio and TV broadcasts are in the process of being digitalized. Digital broadcast can provide various information (e.g., news, stock, weather, traffic information, etc) as well as audio and video contents.

SUMMARY

In one general aspect, a method for processing traffic information including composite links is provided. The method includes receiving traffic information including a composite identifier enabling a determination of whether the received traffic information includes composite link information, a composite traffic status indicator revealing traffic status information corresponding to a composite link that includes at least first and second links, and at least first and second link identifiers respectively corresponding to the first and second links that are included within the composite link. The method also includes determining, based on the composite identifier, whether the received traffic information includes composite link information. The method further includes dependent upon whether the composite identifier enables a determination that the received traffic information includes composite link information, identifying the composite link among the received traffic data based on at least the first and second link identifiers, identifying the received composite traffic status indicator as composite traffic status information for the composite link, and enabling perception of an association between the received traffic status information and the composite link.

Implementations may include one or more additional features. For instance, the method may include receiving an indicator of a number of links included in the composite link. The number of links included in the composite link may correspond to a number of link identifiers indicated by the received traffic information. When the indicator of the number of links included in the composite link is three, the received traffic information may correspondingly include a third link identifier in addition to the first and second link identifiers. Receiving a composite traffic status indicator may include receiving at least one of a predicted or current traffic tendency on the composite link, a predicted or current amount of traffic on the composite link, a predicted or current speed on the composite link, and a predicted or current time to traverse the composite link.

The method may also include receiving information corresponding to a message management structure including information corresponding to a generation time of the composite link information included in the message management structure. The generation time included within the received message management structure may relate to the composite traffic status indicator corresponding to at least one of a predicted or current traffic tendency on the composite link, a predicted or current amount of traffic on the composite link, a predicted or current speed on the composite link, and a predicted or current time to traverse the composite link. The composite link component may be associated with the received composite traffic status indicator. The composite traffic status indicator may correspond to the status of the composite link or links included within the composite link. Receiving composite link information may include receiving vertex, coordinate, or longitude and latitude information that corresponds with a location associated with the composite link or links included within the composite link. Receiving composite link information may include receiving location information corresponding to each of the first and second link identifiers. Receiving composite link information may include receiving a text descriptor associated with the composite link.

After the traffic information has been received and processed to determine that the composite traffic status information is associated with at least the first and second links within the composite link, the method may further include receiving supplemental traffic information that includes a supplemental composite link information identifier that enables determination that the supplemental traffic information includes supplemental composite link information, information identifying the composite link as the link to which the supplemental composite link information relates, and an identifier of at least one additional link to be included in the composite link and associated with traffic status information received for the composite link. This implementation may include determining, based on the supplemental composite link identifier, whether the received supplemental traffic information includes supplemental composite link information. This method may further include dependent upon whether the supplemental composite link identifier enables a determination that the received supplemental traffic information includes supplemental composite link information, identifying the composite link based on the supplemental traffic data, identifying the additional link based on the received additional link identifier, and redefining the composite link as including the additional link.

Further, in the method, redefining the composite link may include redefining the composite link as including the additional link, and applying traffic status information received for the composite link to the portion of the composite link corresponding to the additional link. Redefining the composite link may include redefining the composite link as excluding a link corresponding to the additional link, the method further including applying traffic status information received for the composite link to only the portion of the composite link that does not include the additional link. The supplemental traffic information may be received without an indication of the first and second link identifiers. The received composite traffic status indicator may enable determination of traffic status information for only a single direction of travel along the composite link.

Also, in the method, the received composite traffic status indicator may enable determination of traffic status information for both directions of travel along the composite link, and may include receiving supplemental traffic information that includes a supplemental composite link information identifier that enables determination that the supplemental traffic information includes supplemental composite link information, information identifying the composite link as the link to which the supplemental composite link information relates, and a composite travel direction indication that enables a determination of whether to enable or disable access to traffic status information for a direction of travel along the composite link. This implementation may also include determining, based on the supplemental composite link identifier, whether the received supplemental traffic information includes supplemental composite link information. This implementation may further include dependent upon whether the supplemental composite link identifier enables a determination that the received supplemental traffic information includes supplemental composite link information, identifying the composite link based on the supplemental traffic data, and identifying, based on the composite travel indication, whether to enable or disable access to traffic status information for a direction of travel along the composite link.

Further, in the method, enabling perception of an association between the received traffic status information and the composite link may include enabling perception along a single link of traffic status information for the single link in addition to traffic status information for composite links within which the single link is included.

In another general aspect, a traffic information communication device configured to process traffic information including composite links is provided. The device includes a data receiving interface configured to receive composite link information. The information includes a composite identifier enabling a determination of whether the received traffic information includes composite link information, a composite traffic status indicator revealing traffic status information corresponding to a composite link that includes at least first and second links, and at least first and second link identifiers respectively corresponding to the first and second links that are included within the composite link. The device also includes a processing device configured to process information received from the data receiving interface and to determine composite link characteristic information based at least in part on the composite link information received.

Implementations may include one or more additional features. For instance, the processing device may also be configured to determine, based on the composite identifier, whether the received traffic information includes composite link information. The processing device may further be configured to, dependent upon whether the composite identifier enables a determination that the received traffic information includes composite link information, identify the composite link among the received traffic data based on at least the first and second link identifiers, identify the received composite traffic status indicator as composite traffic status information for the composite link, and enable perception of an association between the received traffic status information and the composite link.

Also, in the device, the data receiving interface may receive a data length. The processing device may use the data length to determine an amount of the received data to attribute to the composite link information. The processing device may be configured receive a version number corresponding to information within the received composite link information. The version number may be associated with a specific syntax of the data where any one of multiple syntaxes may be used. The data receiving interface may receive an indicator of a number of links included in the composite link. The processing device may be configured to determine a number of links included in the composite link based on the received indicator of the number of links. The data receiving interface may receive and the processing device may process at least one of a predicted or current traffic tendency on the composite link, a predicted or current amount of traffic on the composite link, a predicted or current speed on the composite link, and a predicted or current time to traverse the composite link.

Further, in the device, the data receiving interface may receive, after the traffic information has been received and processed to determine that the composite traffic status information is associated with at least the first and second links within the composite link, supplemental traffic information. The supplemental traffic information may include a supplemental composite link information identifier that enables determination that the supplemental traffic information includes supplemental composite link information, information identifying the composite link as the link to which the supplemental composite link information relates, and an identifier of at least one additional link to be included in the composite link and associated with traffic status information received for the composite link. The processing device may be configured to perform, upon receipt of the supplemental traffic information, the steps of determining, based on the supplemental composite link identifier, whether the received supplemental traffic information includes supplemental composite link information. The processing device may also be configured to, dependent upon whether the supplemental composite link identifier enables a determination that the received supplemental traffic information includes supplemental composite link information, identifying the composite link based on the supplemental traffic data, identifying the additional link based on the received additional link identifier, and redefining the composite link based on as including the additional link.

Also, in the device, the processing device may be configured to redefine the composite link as including the additional link, and to apply traffic status information received for the composite link to the portion of the composite link corresponding to the additional link. The processing device may be configured to redefine the composite link as excluding a link corresponding to the additional link, and to apply traffic status information received for the composite link to only the portion of the composite link that does not include the additional link. The data receiving interface may receive the supplemental traffic information without receiving therewith an indication of the first and second link identifiers.

In a further general aspect, an apparatus for processing traffic information including composite links is provided. The apparatus includes means for receiving traffic information including a composite identifier enabling a determination of whether the received traffic information includes composite link information, a composite traffic status indicator revealing traffic status information corresponding to a composite link that includes at least first and second links, and at least first and second link identifiers respectively corresponding to the first and second links that are included within the composite link and means for determining, based on the composite identifier, whether the received traffic information includes composite link information. The apparatus also includes means for, dependent upon whether the composite identifier enables a determination that the received traffic information includes composite link information, performing the steps of identifying the composite link among the received traffic data based on at least the first and second link identifiers, identifying the received composite traffic status indicator as composite traffic status information for the composite link, and enabling perception of an association between the received traffic status information and the composite link.

The details of one or more implementations are set forth in the accompanying drawings and the description below. Other features will be apparent from the description and drawings, and from the claims

DETAILED DESCRIPTION

One such use for digital broadcasts is to satisfy an existing demand for traffic information. Proposals that involve the use of digital broadcasts for this purpose contemplate the use of standardized formatting of traffic information to be broadcast. This approach may be used to enable the use of traffic information receiving terminals made by different manufacturers, which each could be configured to detect and interpret traffic information broadcast in the same way.

Figure 1:
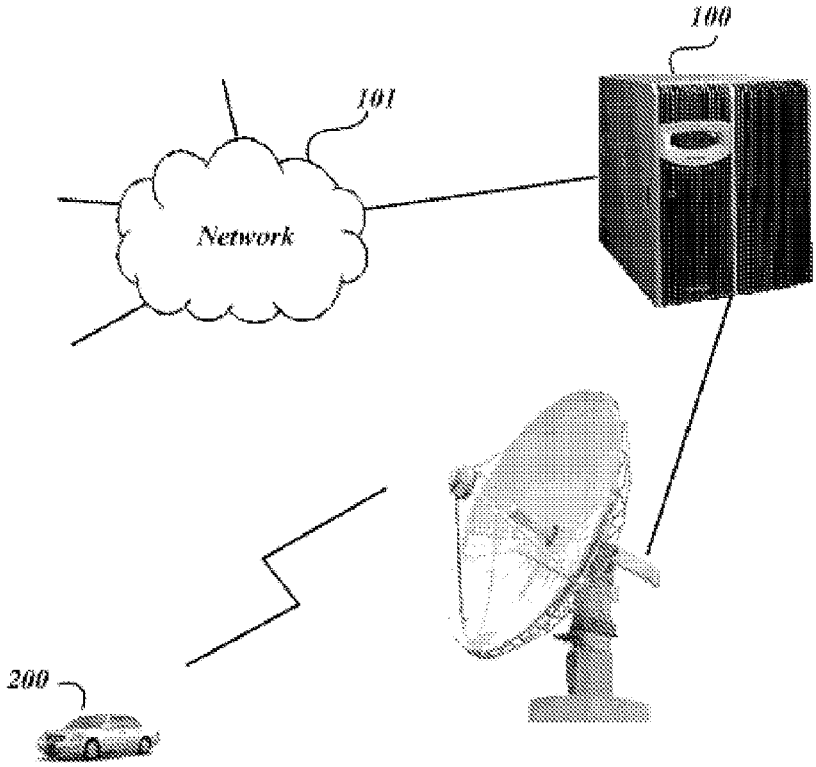
FIG. 1 illustrates a schematic diagram of a network through which traffic information is provided.

FIG. 1 is a schematic diagram of a network through which traffic information is provided. A traffic information providing server 100 in a broadcast station may transmit traffic information, e.g., traffic congestion information collected from various sources (e.g., operator input, or information received from another server or probe cars through a network 101) wirelessly so that a traffic information receiving terminal (e.g., navigation system installed in a car 200) may receive the traffic information. In the below explanation about implementations, the traffic information means traffic congestion information.

Figure 2A:
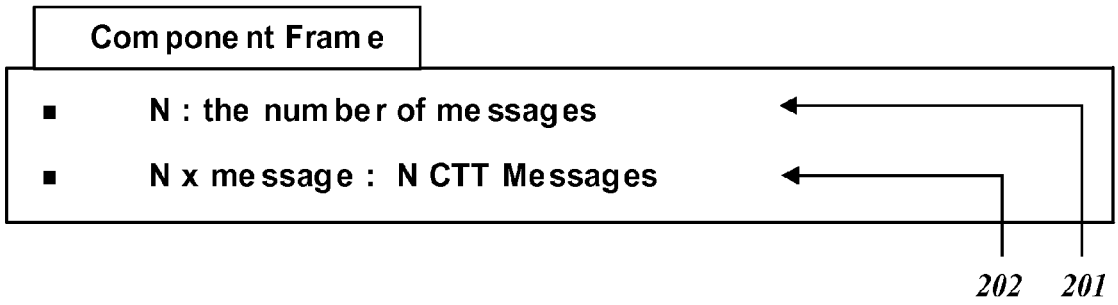
FIG. 2*a* illustrates a partial syntax of a component frame including traffic information.

The traffic information wirelessly transmitted from the traffic information providing server 100 may be of the form of a component frame. As shown in FIG. 2*a*, a component frame may include a field 201 indicative of the number of messages included therein and a sequence of transport protocol expert group messages 202, the number of the messages being equal to the value stored in the field 201. The transport protocol expert group message will be referred to as the TPEG-CTT message hereinafter.

Figure 2B:
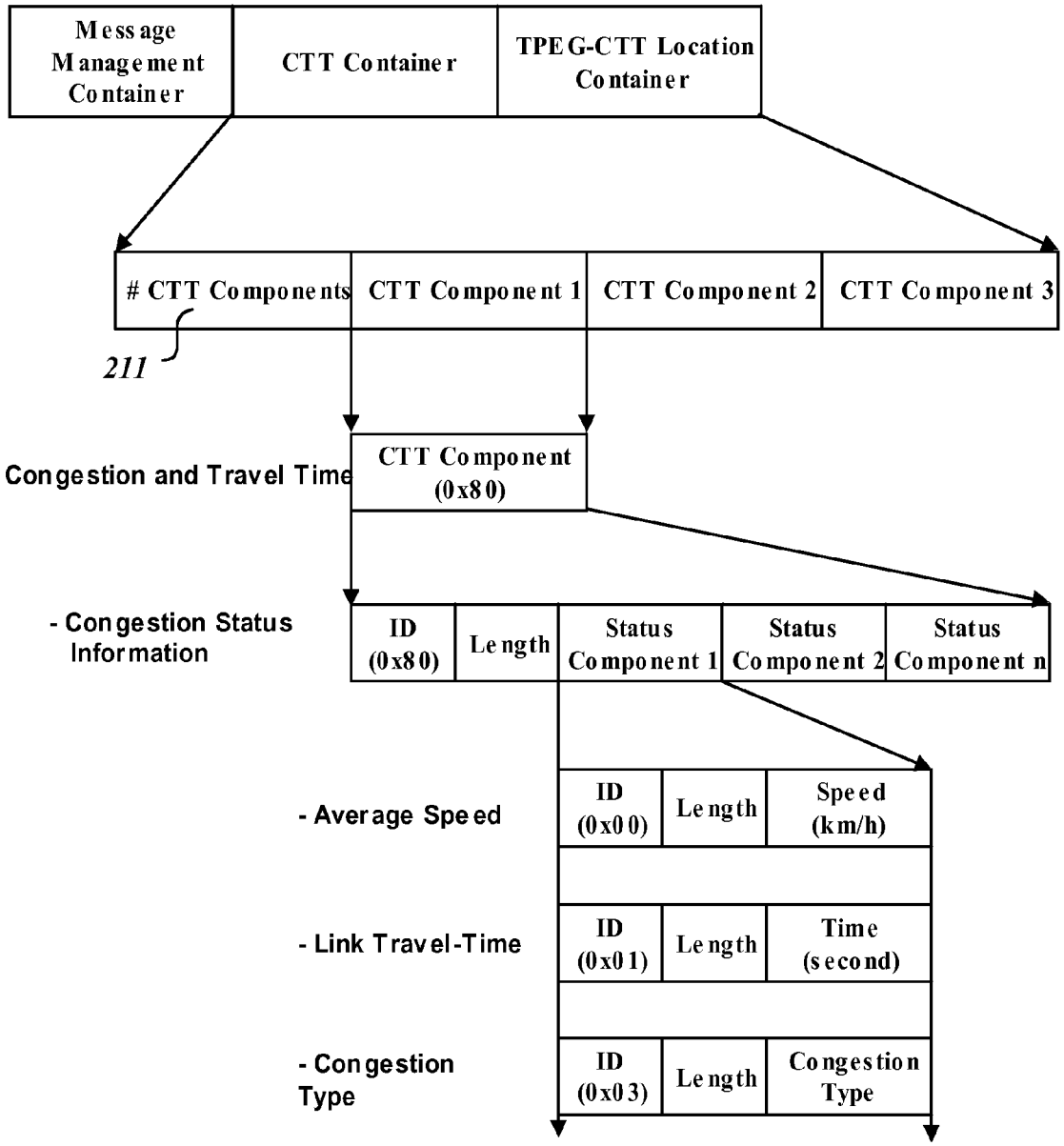
FIG. 2*b* illustrates a format of a TPEG-CTT message with an emphasis on status components delivering traffic information.
Figure 2C:
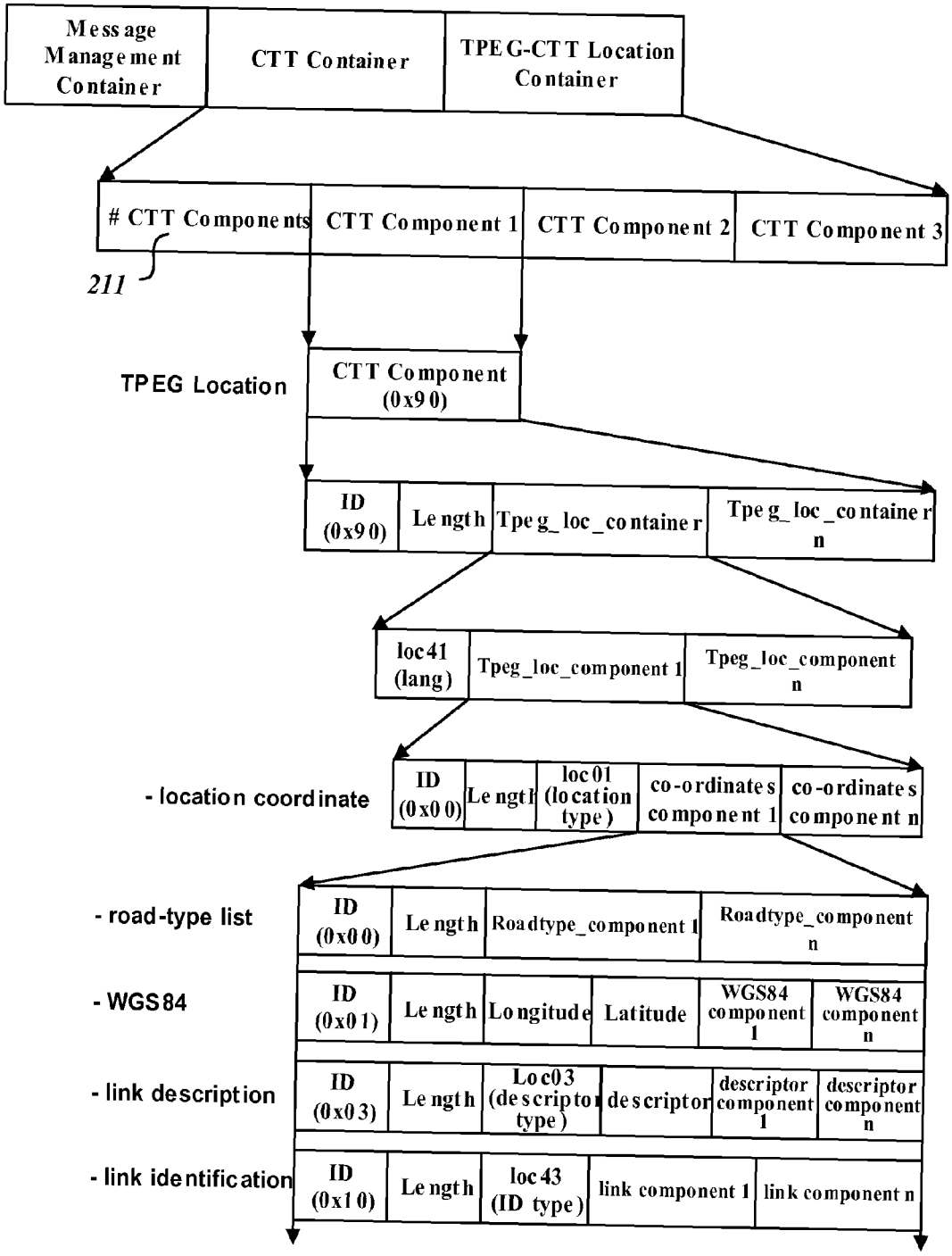
FIG. 2*c* illustrates a format of a TPEG-CTT message with an emphasis on coordinate components delivering link information.

As shown in FIGS. 2*b* and 2*c*, one message segment of the sequence 202, i.e., one TPEG-CTT message, may include a message management container including information on date and time, the message occurrence time, etc., a congestion and travel-time information (CTT) container, and a TPEG-CTT location container. The CTT container may include a field 211 indicative of the number of CTT components included in the CTT container and the TPEG-CTT location container. The field 211 may be followed by CTT components, the number of which is equal to the value stored in the field 211.

In various implementations, if a CTT component includes traffic congestion information, the CTT component is given an ID of 0x80, as shown in FIG. 2*b*, and includes one or more status components therein. Each status component may include an ID indicative of the information included therein. For example, a status component including an ID of 0x00 delivers the average speed in a link (a road unit including no branch therein). A status component including an ID of 0x01 delivers link travel time. A status component including and ID of 0x03 delivers information on the degree or type of congestion. In the description, specific IDs are described as assignments to structures associated with specific information. The actual value of an assigned ID (e.g., 0x80) is exemplary, and different implementations may assign different values for specific associations or circumstances. Thus, the CTT component may be used to provide various different types of data that may be signaled based on an identifier. For example, FIG. 2B illustrates components with identifiers of 0x00 and 0x01 signaling, respectfully, speed and travel-time information.

Further, according to the various implementations if a CTT component includes link location information, the CTT component is given an ID of 0x90 as shown in FIG. 2*c* and includes one or more TPEG-CTT location sub-containers. Each TPEG-CTT location sub-container 'Tpeg_loc_container' includes one or more TPEG-CTT location components, each of which includes one or more coordinate components having an ID of 0x00. Each coordinate component delivers information on a link or links for which the status component includes traffic information. A link may refer to a road segment which starts and ends at junctions and has no junction in between. A coordinate component including an ID of 0x00 includes information on the link type (e.g., express way, national road, etc). A coordinate component including an ID of 0x01 includes coordinate information which may be expressed in the WGS84 format. A coordinate component including an ID of 0x03 includes link description information and a coordinate component including an ID of 0x10 includes link identification information.

The server 100 may construct the TPEG-CTT information as shown in FIGS. 2*a* through 2*c* from traffic information collected from various sources and may transmit the constructed TPEG-CTT information to traffic information receiving terminals wirelessly.

Information may be provided at a macroscopic scale. For example, if there are two or more possible commutation routes (e.g., Olympic highway, 'Gangbyeonbukro' in Seoul), the driver may be likely to choose one route from among the possible routes based on an indication of an average speed along an aggregation of the routes rather than the average speed in each road segment within the routes. If the traffic information receiving terminal is equipped with the function of providing the average speed in principal roads, the driver may make a request for the average speed in a specific principal road. For another example, a user may view the congestion of multiple highways From the Dulles Airport, VA to the Smithsonian Museum, Washington D.C. in order to recognize an advantageous route.

To meet the need for traffic information at a macroscopic scale, the sever 100, which may collect traffic information in a centralized manner and provide for a terminal, may generate a composite link composed of a plurality of links on a specific road and may provide traffic congestion information for the composite link in a similar manner as traffic congestion information for each link.

A process, according to various implementations, for providing traffic information on a virtual composite link that does not correspond to a single actual link will now be described in detail.

Figures 3A, 3B:
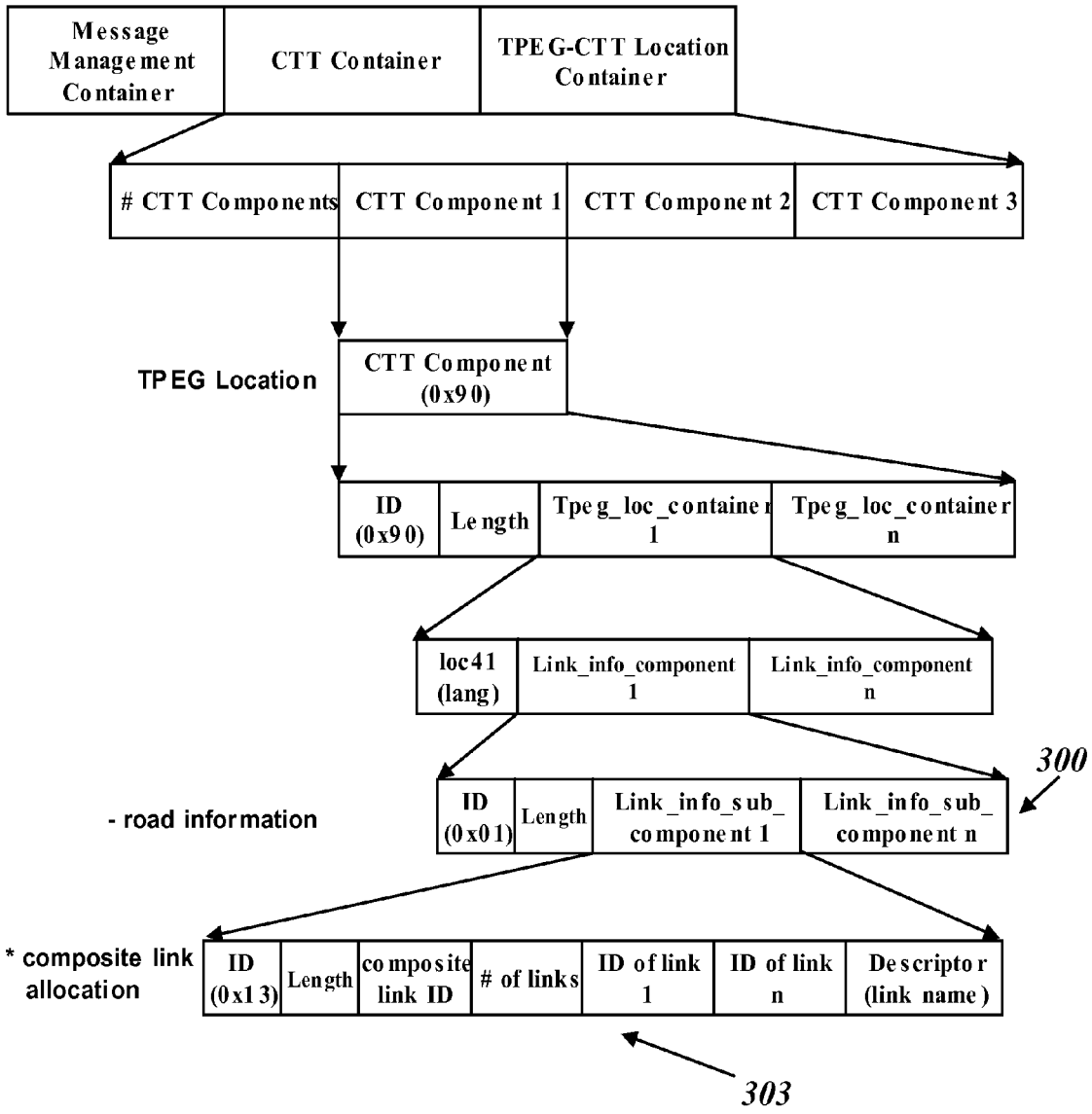
FIG. 3*a* illustrates a syntax of a link information component.
FIG. 3*b* illustrates a format of a TPEG-CTT message with an emphasis on link information components.

To provide traffic information on a composite link defined from a set of links, the server 100 may construct a link information component including an ID of 0x01 as shown in FIG. 3*a* and may deliver the link information component via a TPEG-CTT location sub-container. The link information container, as shown in FIG. 3*b*, may deliver a link allocating sub-component 303 for allocating a composite link comprising successive links via the link information component.

The link allocating sub-component 303 has an ID of 0x02 and may include a composite link ID, the number of links included in the composite link, the IDs of the links included in the composite link, and/or a descriptor. In particular, the link allocating sub-component ID 0x02 is used to trigger recognition of the component as a link allocation sub-component.

The server 100 may construct the TPEG-CTT information as shown in FIGS. 2*a* through 2*c* from traffic information collected from various sources and may transmit the constructed TPEG-CTT information to traffic information receiving terminals wirelessly. Under various circumstances, such as, for example, according to operator input or predefined conditions, the server 100 may create the link allocating sub-component 303 for establishing a composite link comprising a plurality of links (e.g., a set of road segments belonging to a principal road) and delivers the link allocating sub-component 303 via the link information component 300. It is possible to make composite links for a principal road in one direction or in both directions. Making a composite link which has a low demand for traffic information in only one direction helps reduce the size of traffic information, simplify server processing, and provide useful information to a user wishing to perceive travel options along an intended direction of travel.

Figure 3C:
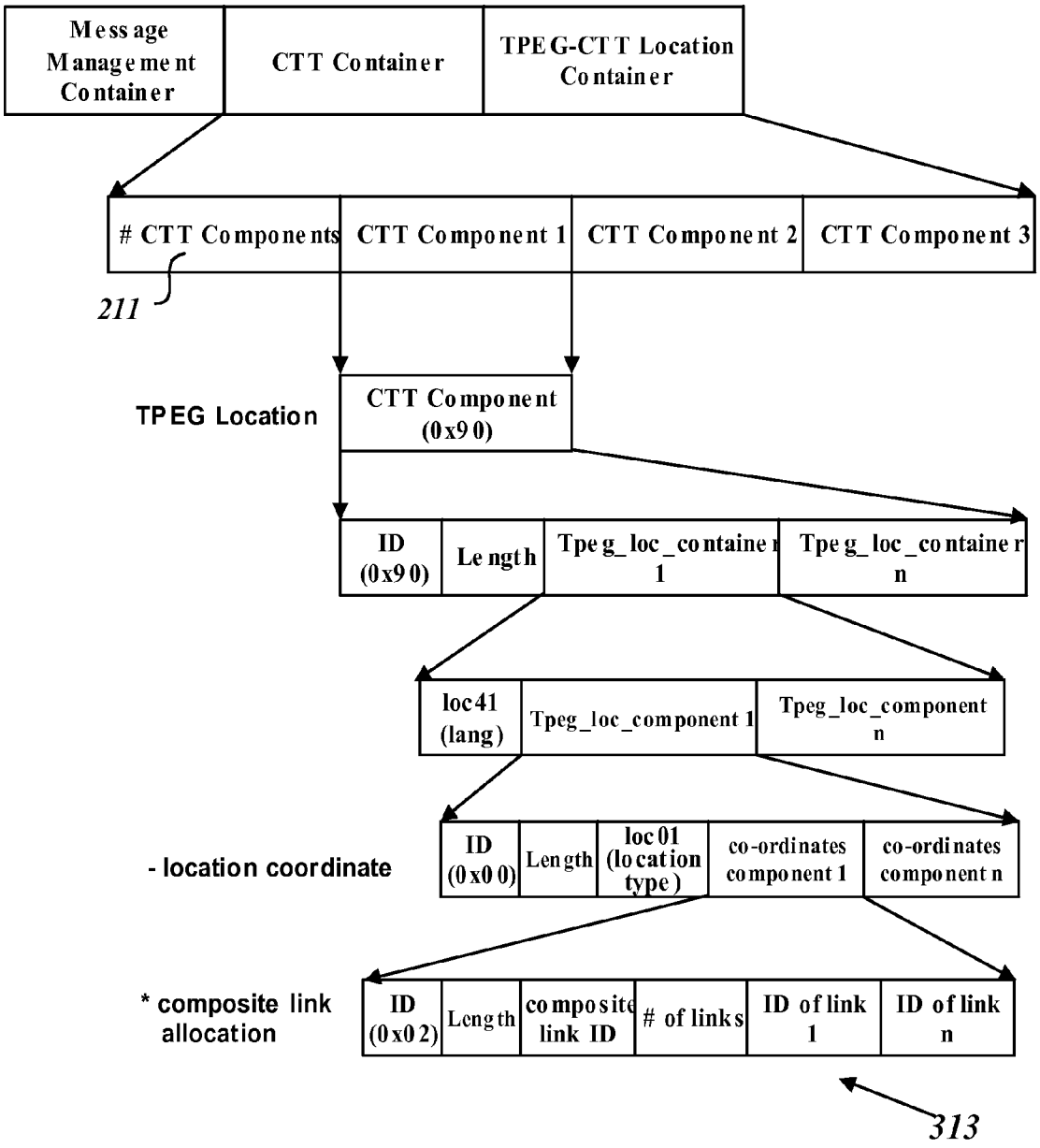
FIG. 3*c* illustrates a format to transmit information on a composite link through coordinate components.

In another implementation, information on allocation of a composite link may be carried by a coordinate component including ID of 0x00, as shown in FIG. 3*c*. In this case, ID of, for example, 0x13 is allocated to a coordinate component carrying information of a composite link information to distinguish from other coordinate components carrying road-type list, WGS84, link description, and link identification.

In this implementation, information that may be needed for allocating a composite link, for example, information on a composite link description, may be included dispersedly in a description component shown in FIG. 2*c*.

The server 100 may calculate traffic information (e.g., average speed, link travel time, the degree of congestion, etc) for the composite link based on traffic information for individual links and transmit the traffic information for the composite link in a similar manner to other links. Since the server 100 may have more powerful performance than traffic information receiving terminals equipped with limited resources, it may be faster and more efficient for the server 100 to obtain traffic information for the composite link.

According to various implementations, if there is a change in the set of links included in a composite link, e.g., a link is added to or removed from the composite link, the server 100 may create and transmits a link allocating sub-component (or composite link allocating coordinate component) for reallocating a composite link composed of the changed set of links. In this case, the server 100 may allocate the sub-component an ID, e.g., 0x03 (or 0x14) instead of 0x02 (or 0x13 indicative of a composite link allocating coordinate component) to inform traffic information receiving terminals that a pre-allocated composite link is reallocated.

In order to cancel an existing composite link, the server 100 may create and transmits a link allocating sub-component for canceling the existing composite link. Canceling an existing sub-component may be useful in reducing the size of traffic information. For example, if a road is congested in one direction in the morning and the same road is congested in the opposite direction in the evening, a composite link for the opposite direction may be unlikely to be of high demand in the morning. As a result, the size of traffic information may be reduced by canceling the composite link for the opposite direction in the morning. In this case, the link allocating sub-component has the ID of the existing composite link to be canceled and the information on the number of links set to 0. It is also possible to create a link canceling sub-component including an ID of 0x04 instead of the link allocating sub-component including the ID of the existing composite link and the number of links set to 0, in which case the link canceling sub-component only includes the ID of the composite link to cancel. In another implementation, a composite link canceling coordinate component including ID of, for example, 0x15 indicative of cancellation of a composite link may be provided.

After a composite link is allocated, the traffic information for each of the links included in the composite link may also be provided.

Because a composite link may be treated as an actual link, the data update interval for a composite link may be made equal to the data update interval for individual links. Hence, drivers may be rapidly informed of the traffic conditions on principal roads, each of which may be managed as composite links.

Figure 4:
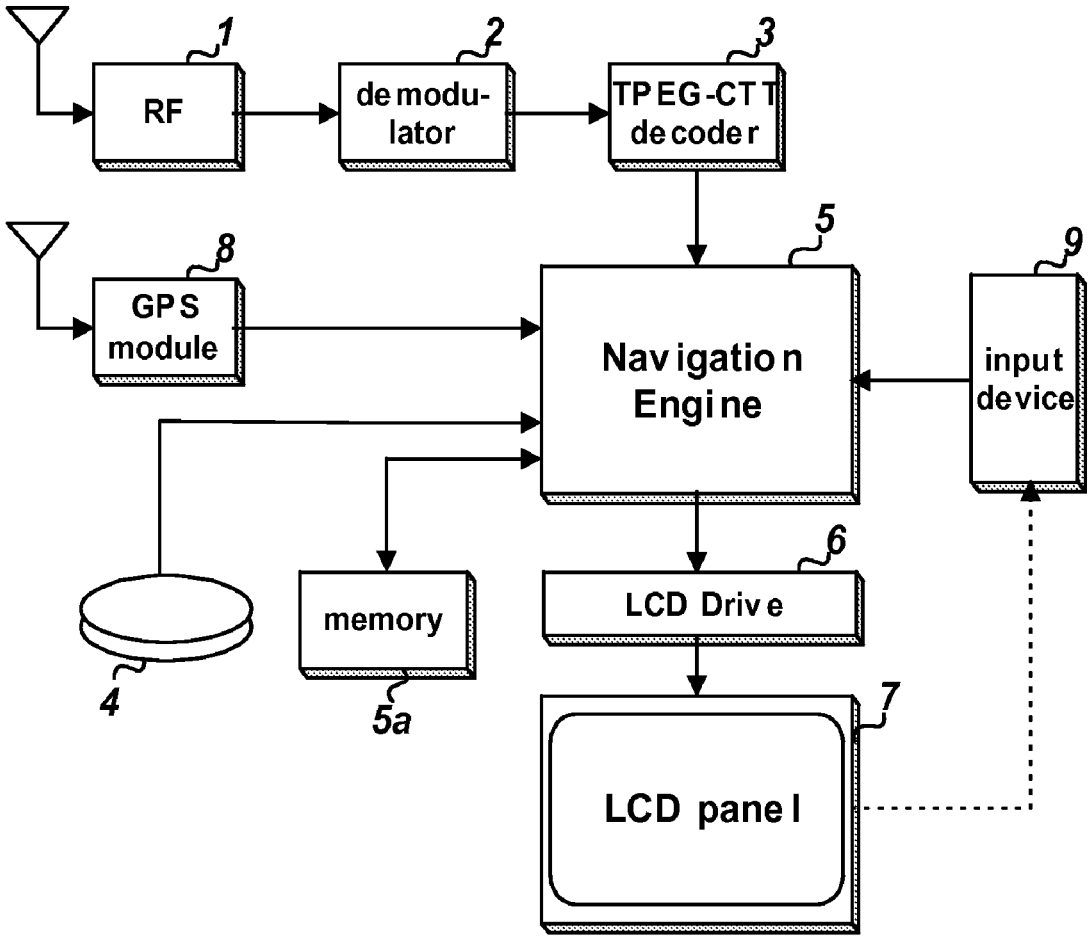
FIG. 4 illustrates a block diagram of a navigation terminal that receives traffic information transmitted from a server.
Figure 5A:
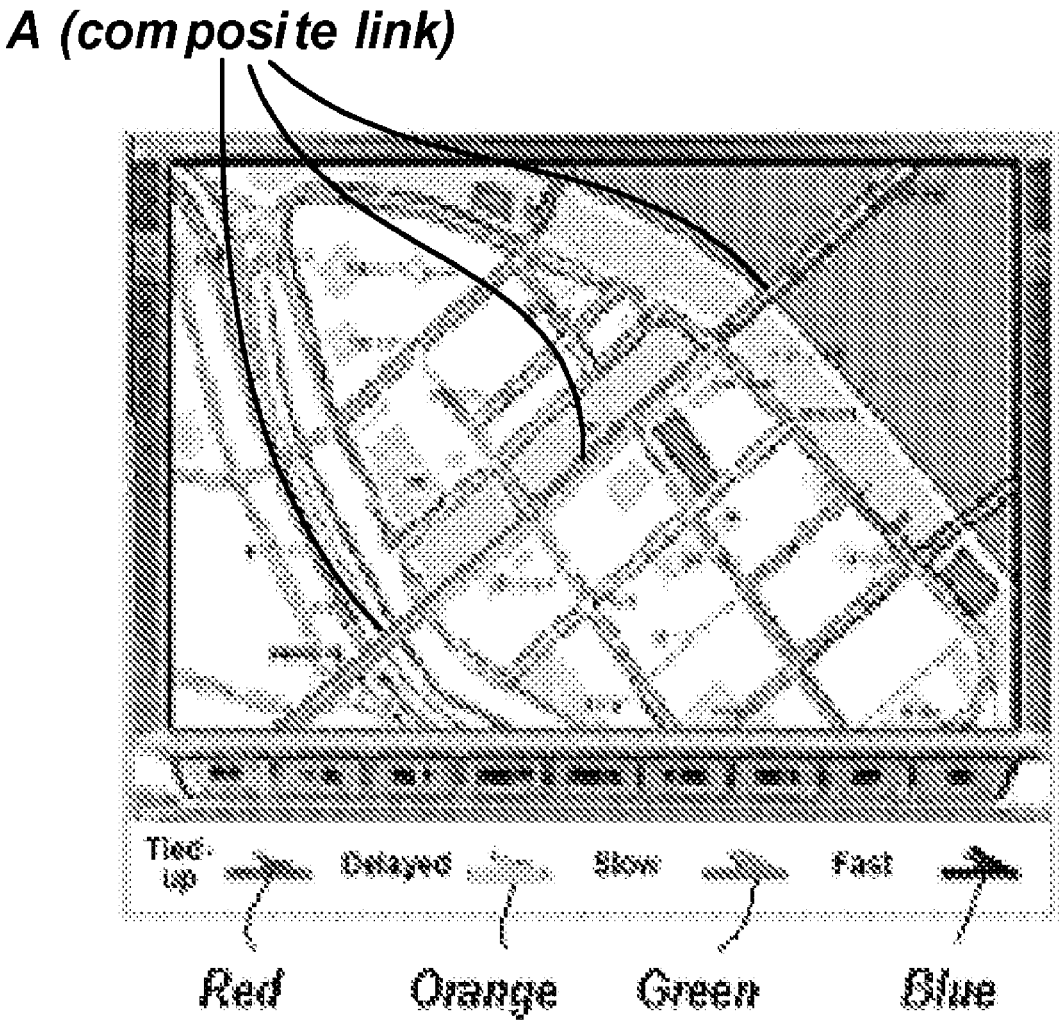
FIGS. 5*a* through 5*c* illustrate examples of displaying traffic information such as average speed in a link, and a composite link.
Figure 5B:
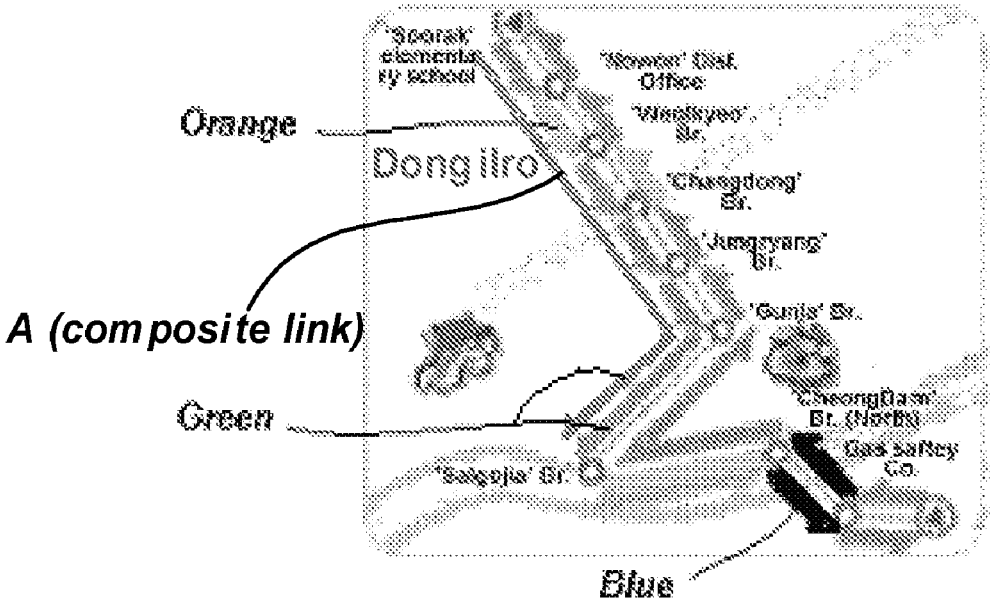
Figure 5C:
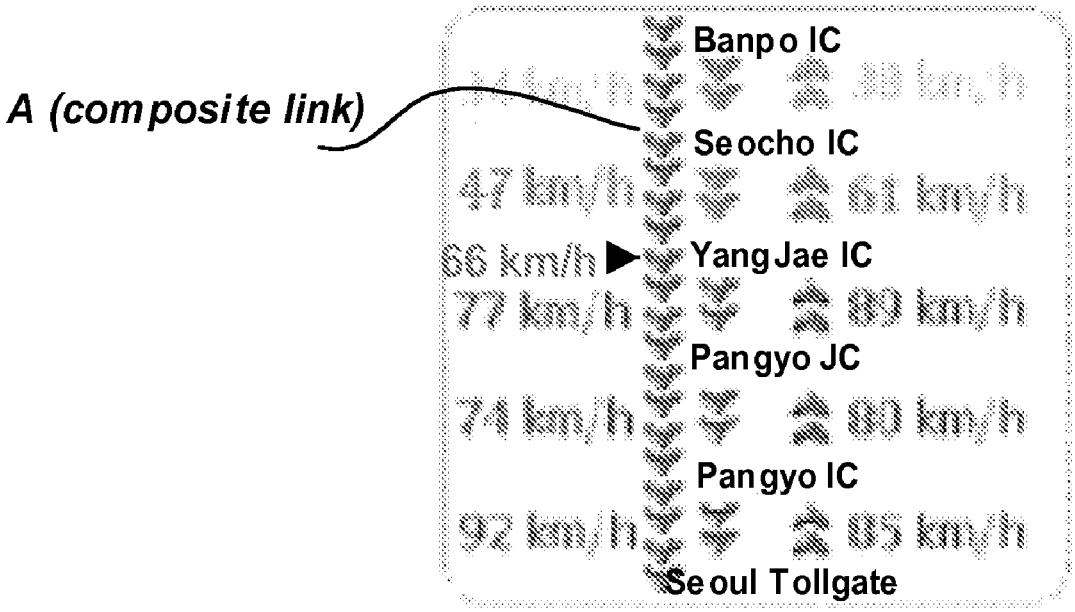
Figure 6:
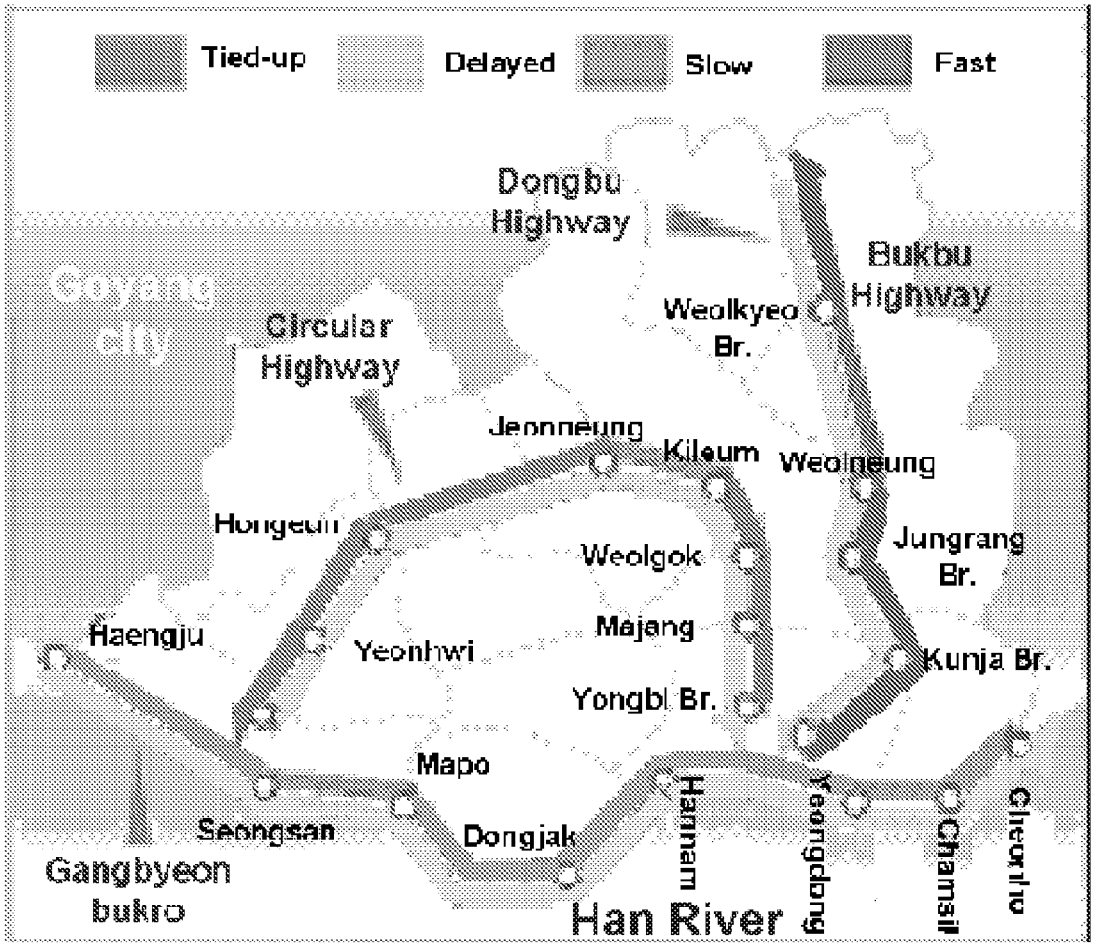
FIG. 6 illustrates an exemplary screen displaying traffic information only for composite links.

FIGS. 4-6 are example implementations of systems for receiving and utilizing traffic information. Other systems may be organized differently or include different components. Specifically, FIG. 4 is an example of a block diagram of a navigation terminal that receives traffic information transmitted from the server 100.

The navigation terminal includes a tuner 1 for receiving modulated traffic information signals by resonating at the required frequency band, a demodulator 2 for outputting traffic information signals by demodulating the modulated signals from the tuner 1, a TPEG-CTT decoder 3 for extracting traffic information by decoding the demodulated traffic information signals, a GPS module 8 for calculating the current position (i.e., latitude, longitude, and altitude) by receiving signals from a plurality of satellites, storage structure 4 for storing various graphic data and an electronic map including information on links and nodes, an input unit 9 for receiving user input, a navigation engine 5 for controlling screen display based on the user input, the current position, and extracted traffic information, a memory 5*a* for storing data temporarily, an LCD panel 7 for displaying data, and an LCD drive 6 for driving the LCD panel 7 according to data to be presented. The input unit 9 may be a touch screen incorporated into the LCD panel 7.

The tuner 1 tunes to the frequency of the signals transmitted by the server 100 and the demodulator 2 demodulates the tuned signals in a predetermined manner. The TPEG-CTT decoder 3 extracts TPEG-CTT messages, as shown in FIGS. 2*a* through 2*c* and FIGS. 3*a* and 3*b* (or 3*c*), and stores the TPEG-CTT messages temporarily. Interpreting the temporarily stored TPEG-CTT messages, the TPEG-CTT decoder 3 sends the extracted information and/or control data to the navigation engine 5. Though various kinds of information is provided for the navigation engine 5 by the TPEG-CTT decoder 3, for purposes of brevity, the following description will focuses on the method for allocating composite links and the method for processing traffic information for composite links.

The TPEG-CTT decoder 3 extracts data/time and message occurrence time included in the message management container of each TPEG-CTT message and determines if the following container is a CTT event container based on 'message element' information (i.e. an identifier). If it is determined that the following container is a CTT event container, the TPEG-CTT decoder 3 provides the navigation engine 5 with the information extracted from the CTT component included in the CTT event container so that the navigation engine 5 may display congestion and travel-time information and link information, which will be described below. Providing the navigation engine 5 with the information may include determining, based on identifiers, that the traffic information includes a message management container including status or composite information within various message components within the message management container. The components may each include different status or composite information associated with different links, composite links, or locations and identifiers associated with the different status or composite information. The containers and components may each include information associated with a generation time, version number, data length, and identifiers of included information.

The TPEG-CTT decoder 3 then extracts information on the link location about which the previously extracted information may be created from the following TPEG-CTT location container. The position information may be, for example, the coordinates (i.e., latitudes and longitudes) of the start and end positions or a link ID, depending on the type of the TPEG-CTT location container. If the navigation terminal is equipped with the storage structure 4, the navigation engine 5 finds the link location about which the received information is created with reference to information on each link and node stored in the storage structure 4. The navigation engine 5 may convert the coordinates of the link into the link ID or vice versa.

In the implementation of FIG. 3*b*, the TPEG-CTT decoder 3 may determine if a link information component including an ID of 0x01 is delivered via a TPEG-CTT location sub-container and if so, extract each sub-component from the link information component.

If the extracted sub-component is a link allocating sub-component (e.g., includes an appropriate identifier), such as including an ID of 0x02 for allocating a composite link, the TPEG-CTT decoder 3 may extract the ID of the composite link to allocate, the number of links included in the composite link, the IDs of the links included in the composite link, and a descriptor (e.g., the road name) and may provide the extracted information for the navigation engine 5 so that the extracted information may be stored as a temporary link entry in the memory 5*a*. If the extracted sub-component is a link canceling sub-component for canceling an existing composite link or a link allocating sub-component including the number of links set to 0, the TPEG-CTT decoder 3 may make a request for removing a temporary link entry including an ID that is the same as the composite link ID of the sub-component so that the navigation engine 5 may remove the composite link entry from the memory 5*a*.

In the implementation of FIG. 3*c*, a composite link allocating coordinate component or a composite link cancellation coordinate component may be extracted from a TPEG-CTT location component including ID of 0x00 included in a TPEG-CTT location sub container, and the above-explained operations may be conducted according to information included in the extracted component.

The navigation engine 5 reads a part of the electronic map centered around the position coordinates received from the GPS module 8 from the storage structure 4 and displays the map on the LCD panel 7 via the LCD drive 6. A particular graphic symbol is displayed at the location corresponding to the current position on the LCD panel 7.

The navigation engine 5 may display the average speed or average travel time in a link received from the TPEG-CTT decoder 3 at a location corresponding to the coordinates or link ID delivered via the TPEG-CTT location container following the container delivering the average speed or average travel time information. In this case, the navigation engine 5 may search the storage structure 4 for the link corresponding to the coordinates or link ID received from the TPEG-CTT location container. If the link is not found, then the navigation engine 5 may determine if there is a matched temporary link entry in the memory 5*a*. In this search operation, temporarily allocated composite links as well as actual links may be searched. The traffic information for the link and/or the composite link specified by the search operation may be extracted from the corresponding status component included in a CTT component including an ID of 0x80.

There are various alternative methods for the navigation engine 5 to display traffic information. For example, the navigation engine 5 may show links in different colors according to the average speed in the links as shown in FIGS. 5*a* and 5*b*, or may show the average speed with number in each link, as shown in FIG. 5*c*. In FIGS. 5*a* and 5*b*, the red, orange, green, blue colors indicate average speeds of 0~10 km, 10~20 km, 20~40 km, over 40 km, respectively.

If the navigation terminal is not equipped with the storage structure 4 for storing an electronic map, the terminal may show the average speed or the travel time in links located in front of the current position with different colors as shown in FIG. 5*b*, or with figures as shown in FIG. 5*c*. If the route of the car with the navigation terminal installed is determined, the navigation terminal may show the average speed in the links included in the determined route instead of the links located in front of the current position.

If the traffic information for a temporary link entry stored in the memory 5*a*, i.e., a composite link, is received, the navigation engine 5 may display the traffic information for the composite link on a road or graphic near each of the links included in the composite link with colors or with figures, as marked 'A' in FIGS. 5*a* to 5*c*. The descriptor for the composite link may also be displayed near the route corresponding to the composite link.

Instead of displaying the traffic information for the composite link together with the traffic information for each of the individual links, the navigation engine 5 may first store the traffic information in the memory 5*a* in association with the temporary link entry and may display only the traffic information for the composite link as shown in FIG. 6 when the traffic information for the composite link is requested.

If the terminal in FIG. 4 is equipped with a voice output device, the terminal may output received traffic information for a specified link, links, or composite link included in a specified route in voice. If several links included in the specified route are grouped into a composite link and the descriptor in the link allocating sub-component (or description component) shown in FIG. 3*b* is "xxx", the voice message may be "the average speed in xxx road is nn".

The present disclosure enable a driver to choose the less congested route from among many possible routes.

In the previous discussion, wherever average speed has been referenced, it may be replaced with other status or component based information, such as, for example, travel time.

The foregoing description has been presented for purposes of illustration. Thus, various implementations with improvements, modifications, substitutions, or additions within the spirit and scope as defined by the following appended claims.

What is claimed is:

1. A method for processing, at a terminal including a receiver and a decoder, traffic information including composite links, the method comprising:

receiving, at a receiver, traffic information including a message, the message including a message management structure, an event structure, and a location structure; and decoding, at a decoder, the received traffic information, wherein the location structure includes a first identifier corresponding to a first link, a second identifier corresponding to a second link, a third identifier corresponding to a composite link that includes the first link and the second link, wherein the event structure includes first traffic congestion information corresponding to the first link, second traffic congestion information corresponding to the second link, and third traffic congestion information corresponding to the composite link, wherein the traffic information further includes information indicating a number of messages included in the traffic information, and wherein the event structure includes information indicating a number of components included in the event structure and the location structure.

2. The method of claim 1, the traffic information further includes an indicator of a number of links included in the composite link, wherein the number of links included in the composite link corresponds to a number of link identifiers indicated by the received traffic information.

3. The method of claim 1, wherein the third traffic congestion information includes at least one of a predicted or current traffic tendency on the composite link, a predicted or current amount of traffic on the composite link, a predicted or current speed on the composite link, and a predicted or current time to traverse the composite link.

4. The method of claim 1, wherein the message management structure further includes information corresponding to a generation time of the composite link information.

5. The method of claim 4, wherein the generation time included within the received message management structure relates to the composite traffic status indicator corresponding to at least one of a predicted or current traffic tendency on the composite link, a predicted or current amount of traffic on the composite link, a predicted or current speed on the composite link, and a predicted or current time to traverse the composite link.

6. The method of claim 1, wherein the traffic information further includes vertex, coordinate, or longitude and latitude information that corresponds with a location associated with the composite link or links included within the composite link.

7. The method of claim 1, wherein the traffic information further includes location information corresponding to each of the first link and the second link.

8. The method of claim 1, wherein the traffic information further includes a text descriptor associated with the composite link.

9. The method of claim 1, wherein the traffic information further includes:

supplemental traffic information that includes a supplemental composite link information identifier that enables determination that the supplemental traffic information includes supplemental composite link information, information identifying the composite link as the link to which the supplemental composite link information relates, and an identifier of at least one additional link to be included in the composite link and associated with traffic status information received for the composite link.

10. The method of claim 9, wherein the supplemental traffic information is received without an indication of the first identifier and the second identifier.

11. A traffic information communication device configured to process traffic information including composite links, comprising:

a data receiving interface configured to receive traffic information including a message, the message including a message management structure, an event structure, and a location structure; and a processing device configured to decode the received traffic information, wherein the location structure includes a first identifier corresponding to a first link, a second identifier corresponding to a second link, a third identifier corresponding to a composite link that includes the first link and the second link, wherein the event structure includes first traffic congestion information corresponding to the first link, second traffic congestion information corresponding to the second link, and third traffic congestion information corresponding to the composite link, wherein the traffic information further includes information indicating a number of messages included in the traffic information, and wherein the event structure includes information indicating a number of components included in the event structure and the location structure.

12. The device of claim 11, wherein the traffic information further includes data length information.

13. The device of claim 11, wherein the traffic information further includes a version number.

14. The device of claim 11, wherein the traffic information further includes an indicator of a number of links included in the composite link.

15. The device of claim 14, wherein the traffic information further includes at least one of a predicted or current traffic tendency on the composite link, a predicted or current amount of traffic on the composite link, a predicted or current speed on the composite link, and a predicted or current time to traverse the composite link.

16. The device of claim 11, wherein:

the traffic information further includes a supplemental composite link information identifier that enables determination that the supplemental traffic information includes supplemental composite link information, the supplemental traffic information including:

information identifying the composite link as the link to which the supplemental composite link information relates, and an identifier of at least one additional link to be included in the composite link and associated with traffic status information received for the composite link.

* * * * *